US005992777A

United States Patent [19]

Aagaard

[11] Patent Number: 5,992,777

[45] Date of Patent: Nov. 30, 1999

[54] COMMUNICATION MACHINE

[75] Inventor: Poul-Erik Aagaard, Daugaard, Denmark

[73] Assignee: Niro Separation A/S, Horsens, Denmark

[21] Appl. No.: 09/043,163

[22] PCT Filed: Sep. 6, 1996

[86] PCT No.: PCT/DK96/00371

§ 371 Date: May 12, 1998

§ 102(e) Date: May 12, 1998

[87] PCT Pub. No.: WO97/10057

PCT Pub. Date: Mar. 20, 1997

[30] Foreign Application Priority Data

Sep. 12, 1995 [DK] Denmark ..... 1010-95

[51] Int. Cl.[6] ..... B02C 18/16

[52] U.S. Cl. ..... 241/236; 241/243

[58] Field of Search ..... 241/236, 243

[56] References Cited

U.S. PATENT DOCUMENTS

| | | | |
|---|---|---|---|
| 519,629 | 5/1894 | Haygood et al. | 241/243 |
| 4,394,983 | 7/1983 | Ulsky | 241/243 |
| 4,489,896 | 12/1984 | Cerroni | 241/243 |
| 4,600,158 | 7/1986 | Matoba | 241/243 |
| 4,678,126 | 7/1987 | Prentice et al. | 241/243 |
| 5,201,475 | 4/1993 | Nakagomi | 241/243 |

FOREIGN PATENT DOCUMENTS

| | | |
|---|---|---|
| 169378 | 9/1991 | Denmark . |
| 0412004 | 2/1991 | European Pat. Off. . |
| WO91/14501 | 10/1991 | WIPO . |

*Primary Examiner*—Mark Rosenbaum

*Attorney, Agent, or Firm*—Jacobson. Price, Holman & Stern, PLLC

[57] ABSTRACT

A machine (1) is serving the purpose of comminution for example domestic garbage, refrigerators, tires, furniture, carpets, mattresses, stubs, demolition timber and similar materials. The machine has a funnel (2) for accommodating the waste, a cutting table (4) placed at the bottom of the funnel with at least one set of fixed, parallel lower knives (9*a,b*) which mutually are separated by openings (10*a,b*) through the table, at least one rotatable axle (5*a,b*) of a drive unit (7) which axle is placed above the cutting table into a direction, which extends perpendicular to the lower knives, and a number of disc-shaped upper knives (8*a,b*) fixed to the axle, each of which knives is provided with a number of teeth (13*a,b*) and partly extends down into each their opening of the table. The lower knives are running into a direction, which intersects the axis (18) of the axle or an area around this. Thereby it is obtained that the teeth of the upper knives will have angle of action of about 90°, and the stress of forces, which they exercise, will have no substantial components into the radial direction of the upper knives and along the lower knives. The advantage of this construction is that the machine is able to securely, in a fast way and efficiently carry out a process of comminution by optimum utilizing the supplied energy, and with the given dimensions the machine has furthermore a larger capacity than known hitherto.

14 Claims, 9 Drawing Sheets

COMMUNICATION MACHINE

The invention concerns a machine of the kind which serves the purpose of comminution for example domestic garbage tires, furniture, carpets, mattresses, stubs, demolition timber and similar materials, and which comprises a funnel for accommodating the waste, a cutting table placed at the bottom of the funnel with at least one set of fixed, parallel lower knives, which mutually are separated by openings through the table, at least one rotatable axle of a drive unit, which axle is placed above the cutting table into a direction, which extends perpendicular to the lower knives, and a number of disc-shaped upper knives fixed to the axle, each of which knives is provided with a number of teeth and partly extends down into each their opening of the table, whereby each opening is wider than the associated upper knife which furthermore is placed close to one of the lower knifes in the associated opening.

The above named materials often have a considerable size and will therefore have to be split up into smaller pieces, that is, comminuted in order not to take up unnecessary space during transportation and by depositing or composting. The same applies for the materials which are to be recycled, e.g. larger plastic parts from scraped cars. Materials which are to be burned will equally have to be comminuted in order to make it possible in practice to handle the materials in a modern combustion plant and obtain a satisfactory combustion.

From the applicant's Danish Patent No. 169378, which is incorporated in the present application as a reference, a machine for comminution of such materials is known. This machine has two upper knives, and the cutting table with the lower knives is extending horizontally somewhat below the axles. The openings of the cutting table are wider than the upper knives, and each upper knife is placed close to one of the lower knives in the associated opening. Thereby a free part of the opening is left between the upper knife and the second one of the lower knives of the opening.

When the machine is operating, and a piece of a material has been seized by the teeth of one of the rotating upper knives, the piece of material is pressed down towards the two lower knives in the opening and is stressed to cutting by especially the lower knife abutting the upper knife. At the same time, however, the piece of material is stressed to be deformed by bending and breaking or tearing since the piece of material freely spans the opening between the two knives.

Due to the configuration of the machine with the cutting table situated below the axles, a cylinder surface, containing a periphery of an upper knife, will intersect a plane, which contains the associated lower knives, in an acute angle, which forms the angle of action of the teeth in relation to the lower knives.

This acute angle of action results in the fact that the teeth are stressed by tangential as well as radial forces. The reaction from the radial forces do not contribute or contribute only to a smaller degree to the comminution of the material, since it mainly are the flanks of the teeth which transfer the radially directed forces to the material, and not their points.

The radial forces stress the teeth to bending, and the teeth will therefore have to be dimensioned for being able to absorb this unfavourable stress of forces, even if the useful effect from the radial forces thereby obtained otherwise is limited. The other components of the machine, such as axles and bearings, will have to be dimensioned for absorbing the radial forces, and therefore, the whole machine will have to be over-dimensioned as compared to the output it in reality is able to provide.

Even if the work which the radial forces are carrying out, when the machine is operating, such only to a smaller degree will be able to contribute to the comminution of the material, the work will nevertheless require supply of energy, which, however, to a large degree will be wasted. The machine will therefore operate with a rather low useful effect.

The tangential stress of forces of the teeth have, due to the acute angle of action, a component crosswise to the lower knives and a second component along these. The crosswise component is efficient in the comminution process, while this is far from being the case with the lengthways component, which, on the contrary, is inclined to push the material along the lower knives. Thereby the machines capability to securely and efficiently being able to comminute the materials is limited, and besides the process frequently will last rather a long time, because the attempts to break the material often will have to be repeated several times, since the direction of rotation of the upper knives first are reversed and whereafter it all starts over again.

Futhermore, EP Patent No. 0412 004 discloses a machine for comminuting materials like syringes or flacons made of glass.

The upper knives of said machine have, however, no wedge-shaped teeth, but are, on the contrary, shaped like a star with arms converging radially outwards. Therefore the upper knives are not able to grasp and keep the material during the comminution process, and the arms will therefore be inclined to push the material outwards on the cutting table instead of grasping and keeping the material on the comminution place of the table.

Furthermore, the upper knives are not placed close to the lower knives on one side of the openings of the cutting table, and the known machine therefore does not provide any possibilities for cutting materials like e.g. tires into smaller pieces.

As the upper knives of the known machine are situated in the middle of the openings of the cutting table the knives moreover cannot break any material.

Thus, the machine known from EP Patent No. 0412 004 is not able to cut, comminute and break materials of the type named in the opening paragraph. The machine is not constructed for handling such operations and is of another kind.

The object of the invention is to provide a machine of the type mentioned in the opening paragraph, which securely, rapidly and efficiently is able to perform a comminution process, at optimum is able to utilize the energy supplied, and with the given dimensions having a larger capacity than know up till now.

The new and unique according to the invention whereby this is obtained consists in that the lower knives are extending into a direction which intersects the axis of the axle or an area around this, whereby the teeth of the upper knives will form an angle of action of approximately 90° and the stress of forces, which they carry out, have no substantial components into the radial direction of the upper knives and along the lower knives. Thereby the above-mentioned disadvantages and shortcomings of the machine known from the DK Patent No. 169378 are eliminated.

The direction of the lower knives can by an expedient embodiment intersect the axis of the axle, but the machine can also with excellent results operate with other directions, which more specific can be stipulated by the fact that each lower knife forms an angle of between 0° and 30°, preferably between 0° and 15°, and especially between 0° and 5° with a plane containing the axis of the axle and the outer end of the lower knife situated opposite to the axle.

In order to give the machine the greatest possible capacity, a set of lower knives are placed on each side of an axle, whereby the two set of knives two and two can form a V, a reversed V or be flush with each other.

When there are several axles, each of which having a set of lower knives on each side, these two sets of lower knives can be placed with the knives two and two flushing with each other and forming advantageous configurations with the adjoining set of lower knives in the shape of V's or reversed V's, or they can quite simple just be flush with the adjoining lower knives.

In the last mentioned case the flushing lower knives can furthermore form an angle to a horizontal plane, whereby a plane through the axis of the axles will slope downwards transversely of the axles. By means of this construction the machine can by itself remove materials, which it is unable to comminute due to e.g. the size and/or the nature of the material. This takes place by reversing the axles so that all the teeth of the upper knives, being in their upper position in a given moment, will be moving into the same direction as the sloping direction, whereby non-workable materials, which might be lying on the upper knives, are driven out of the machine into this direction, partly with help from the gravitation. In this way the comminution machine will in this embodiment be self-emptying.

A good comminution effect is obtained when at least some of the knives are placed in different levels. Thereby the material will span freely over at least two openings, whereby they more easily can be bended and break or be torn apart.

By a simple and cheap embodiment the lower knives can be straight. When they are arched or provided with a wavy cutting edge less power will be necessary to cut the material as compared to straight knives.

Besides having a cutting edge at the upper side, the knives can, with great advantages, also be provided with a cutting edge at the lower side so that the materials, which from above have got down through an opening, can be cut when the teeth during rotating are passing the associated lower knives in upwards going direction.

When the lower knives have a direction towards the axis of the axles or towards an area around this, they cannot, as known from the machine of DK Patent No. 169378, immediately be assembled end to end. By an expedient embodiment the inner ends of the lower knives in two of the knives, placed at each their side of an axle in a set of lower knives, instead be connected with a bridge below the axle in question.

The invention will be more fully explained below by the following description of embodiments, which just serve as examples, with reference to the drawing, where FIG. 1 shows a machine according to the invention, seen from above, FIG. 2 shows the same machine, seen in section from the side, FIG. 3 shows in a larger scale the same machine, seen in section from the end, FIG. 4 shows, seen in perspective, a cross section of the machine shown in FIGS. 1–3, FIG. 5 shows a variant of the machine shown in FIGS. 1–4 with only one axle, FIG. 6 shows schematically a first embodiment of a machine according to the invention with only one axle, FIG. 7 shows schematically a second embodiment of a machine according to the invention with only one axle, FIG. 8 shows schematically a third embodiment of a machine according to the invention with only one axle, FIG. 9 shows schematically a first embodiment of a machine according to the invention with two axles, FIG. 10 shows schematically a first embodiment of a machine according to the invention with three axles, FIG. 11 shows schematically a second embodiment of a machine according to the invention with three axles, FIG. 12 shows schematically how the teeth of the upper knives are placed when passing the lower knives in a conventional machine, FIG. 13 shows schematically in a first embodiment, how the teeth of the upper knives are placed when passing the lower knives in a machine according to the invention, FIG. 14 shows schematically in a second embodiment how the teeth of the upper knives are placed when passing the lower knives in a machine according to the invention, FIG. 15 shows an embodiment with arched lower knives, and FIG. 16 shows an embodiment with wavy lower knives.

In FIGS. 1–3 a machine according to the invention is generally designated by the reference numeral 1. The machine comprises a large funnel 2 serving for accommodating the material (not shown) which is to be comminuted. The funnel is carried by a frame 3 of a conventional type and is at the bottom provided with a cutting table 4 with an elaboration, which later will be described in details. In the funnel there are furthermore two rotatable axles 5*a,b*, which are journaled in bearings 6 and can be brought to rotate by means of hydraulic engines 7. To each axle there is at a mutual distance, placed a set of disc-shaped upper knives 8*a,b*, which through co-operation with fixed lower knives 9*a,b* being attached to the cutting table 4, comminute the material in the funnel, when the machine is operating. The material comminuted (not shown) falls through openings 10 between the lower knives down upon a conveyer 11 for removing the material comminuted by the machine. The material comminuted is guided, during the fall, into position over the conveyer by guide plates 12*a,b*, extending diagonally inwards towards the conveyer from the bottom side of the cutting table.

FIG. 4 shows, seen in fragments in perspective, more clearly how the cutting arrangement of the machine is constructed. As it can be seen, the upper knives 8*a,b* are provided with wedge-shaped teeth 13 for grasping the material and through co-operation with the lower knives 9*a,b* comminuting this material, when the machine is operating. The shown configuration of the teeth are only as an example, and in practice the configuration is adapted to the material which is to be comminuted. The upper knives are furthermore angularly displaced in relation to each other, so that the teeth points 14 in rows will be placed in a screw line. Thereby is avoided the impact loads which will arise, if all of the teeth in a row would work with the full load at the same time. There is therefore no need for such heavy and thereby expensive machine parts, e.g. axles, bearings and hydraulic engines, that they would be able to absorb the otherwise momentarily operating great impact loads. The screw shape will furthermore have the effect that the machine will have a steady and quiet working motion.

When the machine is operating, the two axles 5*a,b*, are rotating with their upper knives 8*a,b* opposite to each other into the direction of the arrows. The material (not shown), which has been filled into the funnel, will be caught by the teeth 13*a,b*, and forced downwards towards the lower knives 9*a,b*, which together with the upper knives will stress the material to cutting. The openings 10*a,b* are wider than the disc-shaped upper knives 8*a,b*, and the material having larger extension than the width of the openings, will then be freely suspended over the opening and therefore at the same time be stressed to bending and perhaps breaking, when the material is loaded by the teeth of the upper knives. Thus the comminution process in question is a combined comminution process, where the material is subjected to as well cutting as tearing actions. The comminuted material will fall, as said before, via the openings 10*a,b* down upon the conveyer 11, which then removes the material from the machine.

The way the funnel is being filled in combination with the character of the material may cause the material to pack so firmly in front of or under the upper knives that the knives cannot overcome the resistance which the packed material yields against being comminuted. The machine will stuck and it will be necessary to redistribute the material before the comminution process can continue. This redistribution takes place by first reversing either one or both axles and then start all over again in a second attempt to make the upper knives to penetrate the material. Sometimes it can be necessary to repeat this process several times before efficiently succeeding in the comminution of the material. The redistribution can be initiated manually according to the need or automatically by oil pressure of the hydraulic engines, when this oil pressure exceeds a predetermined height. The steering of the machine can also be programmed to start the redistribution process at suitable intervals.

FIG. 5 shows a second embodiment 15 of the machine according to the invention. In this case the machine has only one axle, but otherwise it is constructed in the same way as the machine with two axles shown in FIGS. 1–4. Similar parts are therefore designated with the same reference numeral. At the bottom of the funnel 2 there is placed a cutting table 16 with fixed lower knives 17, which set-wise form an angle to each other.

This configuration is schematically shown in FIG. 6, where it can be seen that the direction of the lower knife 17 intersects the axis 18 of the axle 5. It is obvious that the teeth 13, due to this fact, will be rotating past the lower knife 17 into a direction which forms an angle of 90° with said lower knife, when the machine is operating. This eliminates to a substantial degree advantageously the possibility of the forces, with which the teeth 13 of the upper knife 8 attack the material, having components in the radial direction of the upper knife and along the lower knives. These components, which arise in the machine known from DK Patent No. 169378 will have the effect that the machine would have to be over-dimensioned compared to its capacity and will have to operate with a rather low useful effect. A machine according to the invention will therefore in comparison to a conventional machine with the same capacity have a lower production prize, and also the costs of energy consumption will be lower. The supplied energy will be used to an optimum useful effect. To this can be added, that the machine more securely and more efficiently will be able to comminute the material, when the teeth attack the material directly at an angle of 90° in relation to the lower knives instead of a disadvantageous acute angle.

The direction of the lower knives do not precisely have to be pointed directly towards the axis of the axle in order to obtain said advantageous effect. They can also be pointed towards an area around the axle, e.g. an area situated somewhat below the axle. The material, which is going to be comminuted, will always at the beginning extend somewhat over the lower knives, and consequently, the angle of action of the teeth will therefore change as the teeth penetrate the material. With a suitable choice of the inclination in relation to a plane through the axis of the axle and the ends of the lower knives opposite to the axle, the average angle of action of the teeth can be adjusted to 90°. This means that at the beginning the angle of action will be somewhat larger than 90° and at the end somewhat smaller. The change of angle in the comminution of a piece of material can also be adjusted in that way, that the deviation of 90° is largest at the beginning and smallest at the end, where the load normally will be largest.

The lower knives at each side of the axle can also set-wise be placed on cutting tables, each of which is pivotably placed on a length-going axle 19 at the outer side of the cutting table in question. The inclination of the cutting table and thereby the angle of action of the teeth can thereby be varied in such a way, that it all the time is at optimum during the comminution process.

In the embodiment shown in fragments in FIG. 6 the lower knives form a V, which expediently guides the material towards the middle of the funnel.

Figure 1:
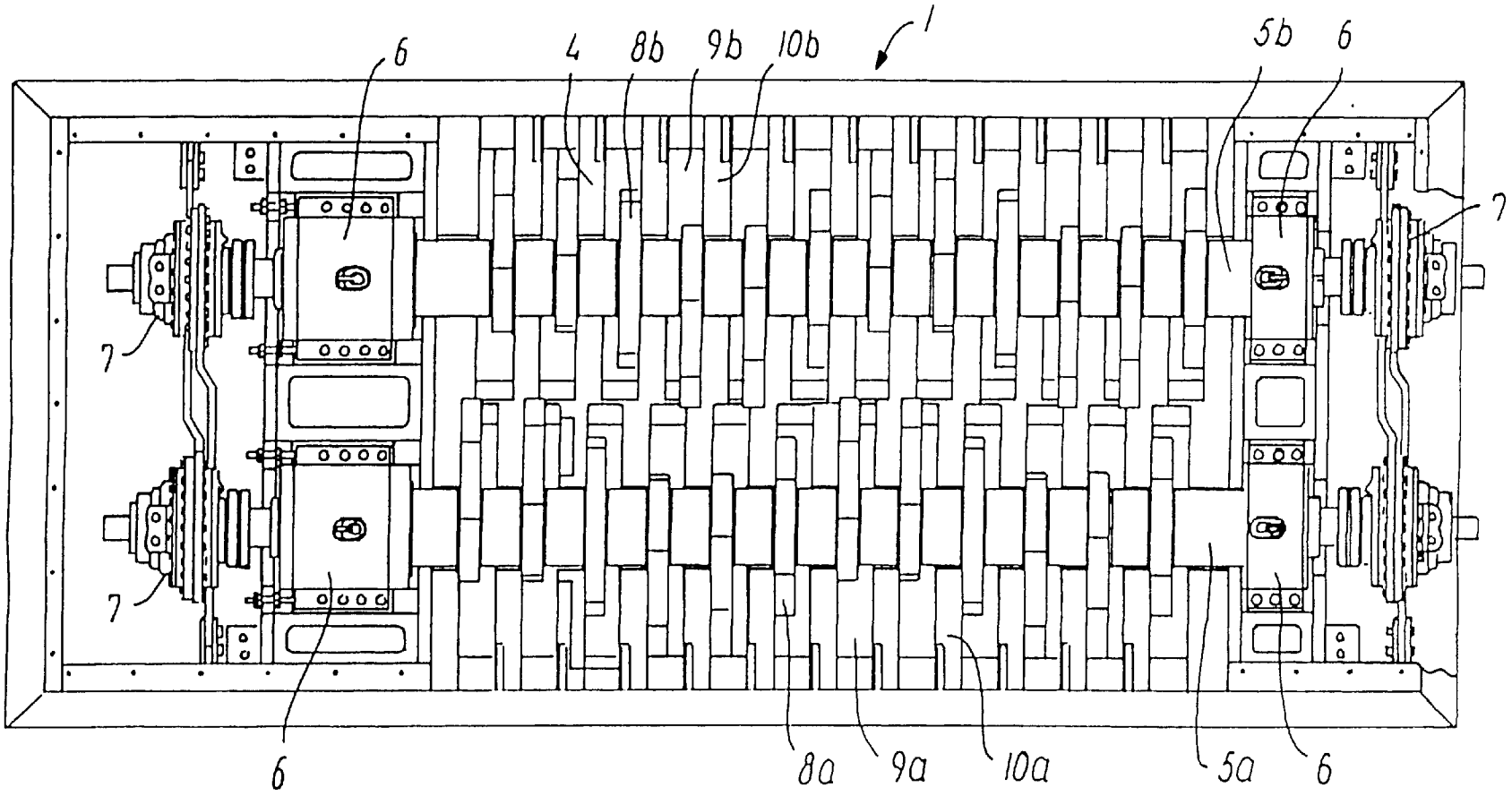
Figure 2:
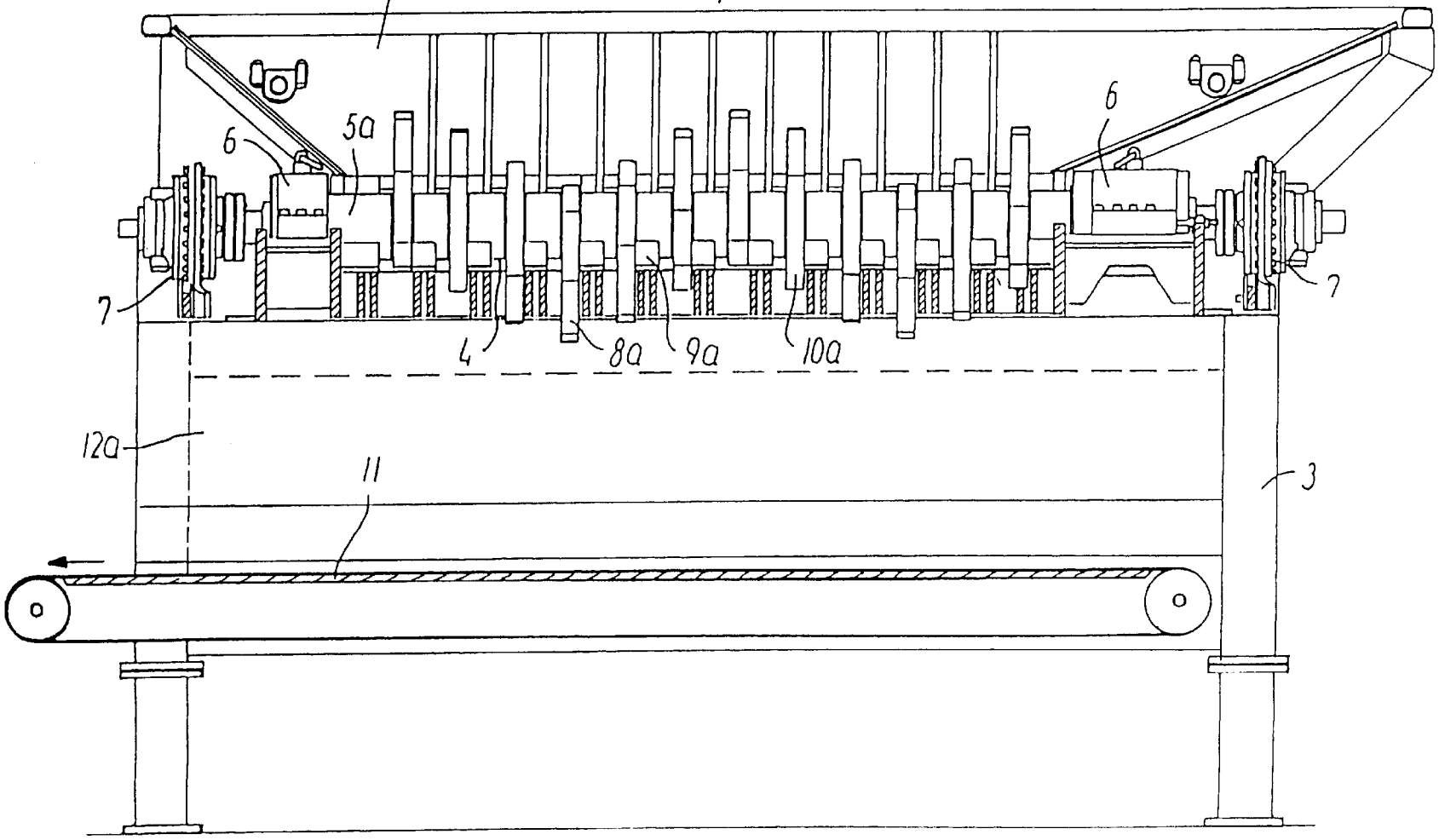
Figure 3:
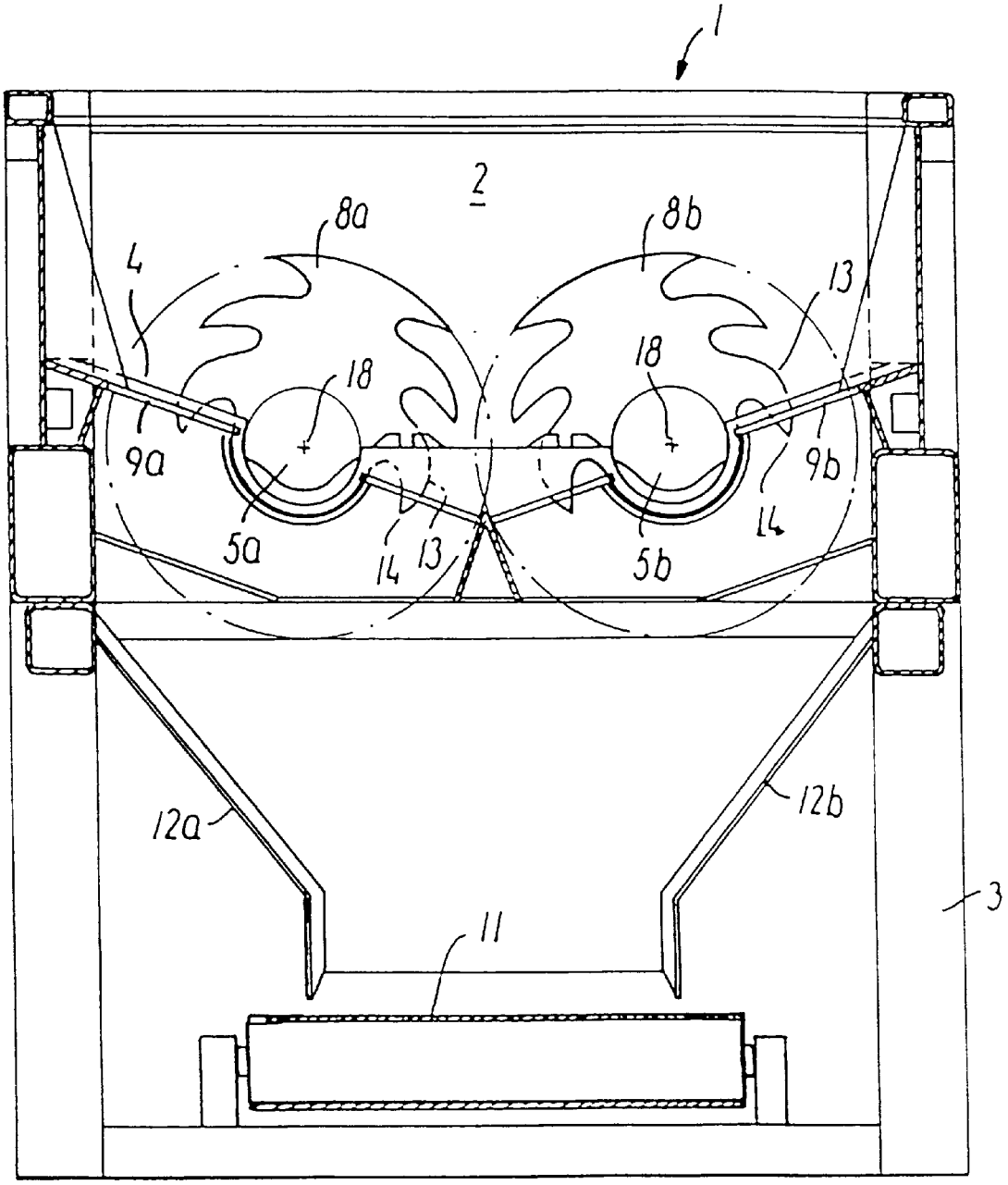
Figure 4:
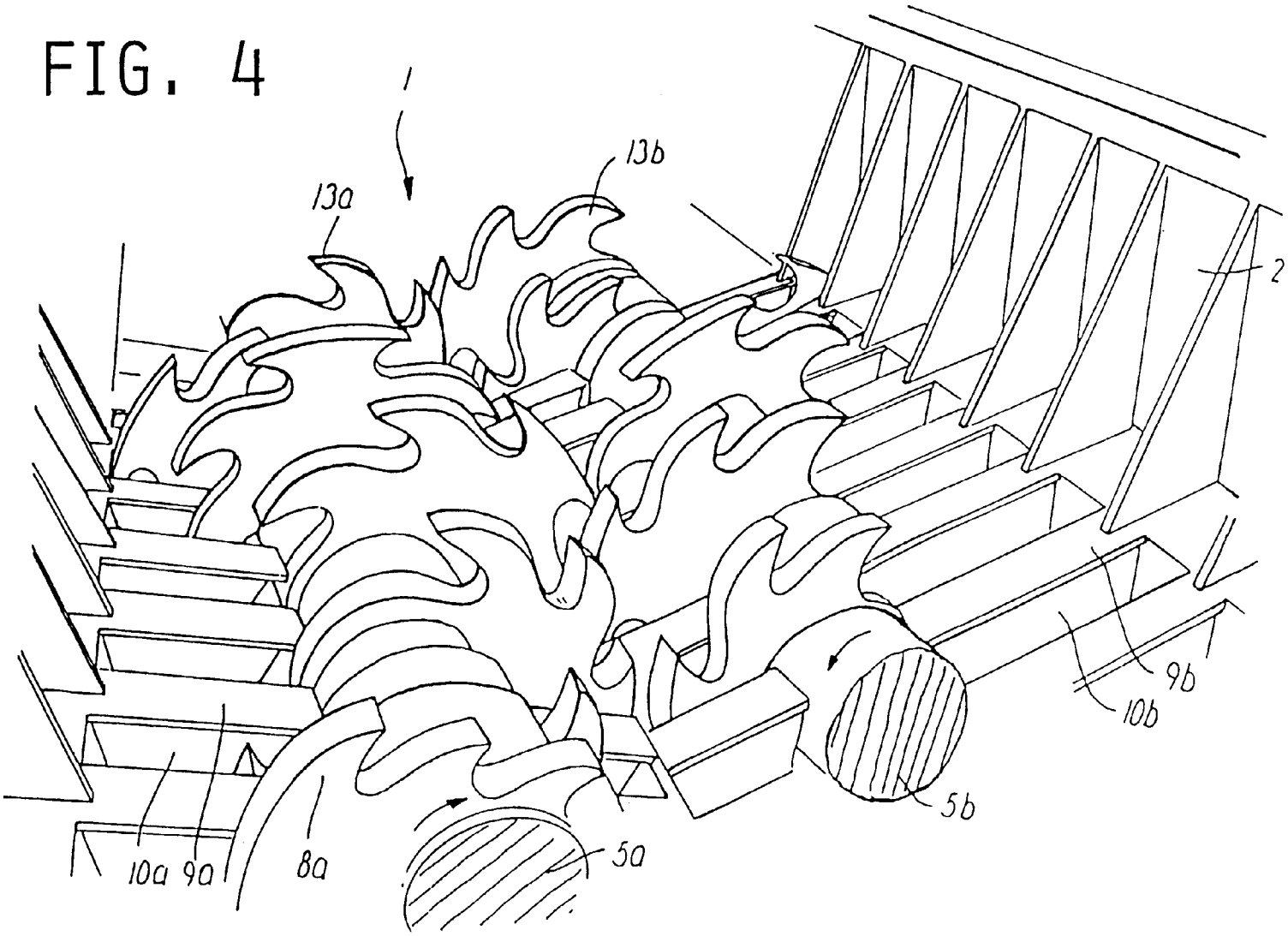
Figure 5:
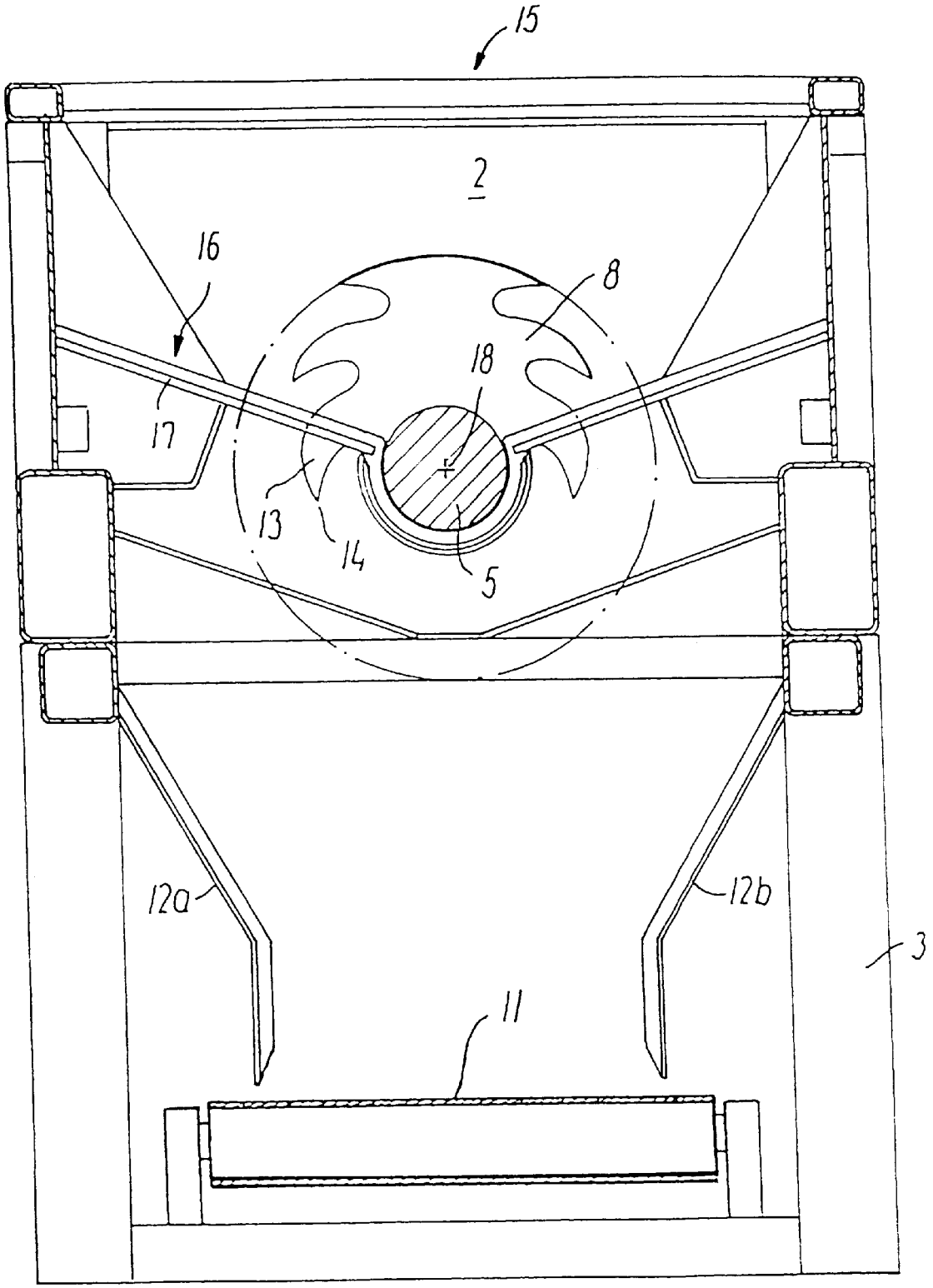
Figure 6:
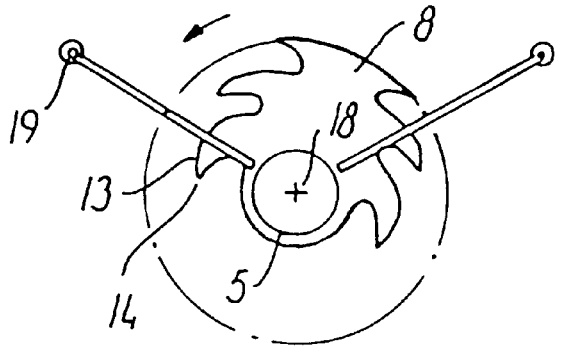
Figure 7:
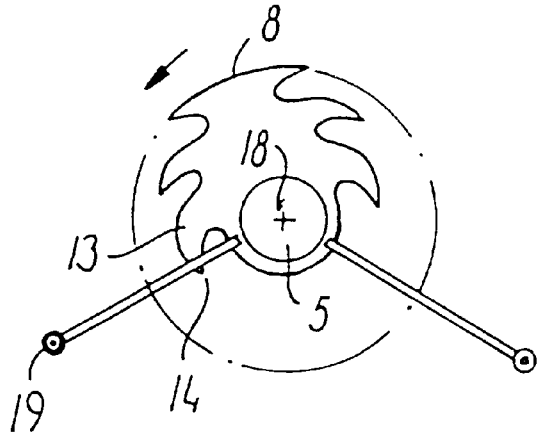
FIG. 7 shows in fragments a second embodiment where the sets of the lower knives form a reversed V. The advantage of this construction is that the teeth will have a larger free scope in the funnel to work the material.
Figure 8:
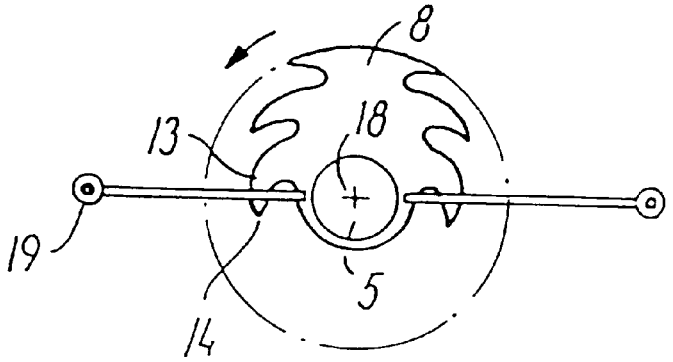
FIG. 8 shows finally, in fragments a third embodiment, where the sets of the lower knives are at equal level. The construction is something between the two embodiments shown in FIGS. 6 and 7, respectively.

The basic idea of the invention with angles of action of the teeth of about 90° is illustrated in FIGS. 6–8 with a machine with only one axle. The same expedient angles of action can, however, as shown schematically in FIGS. 9–11, as a matter of course be obtained with machines with a different number of axles.

Figure 9:
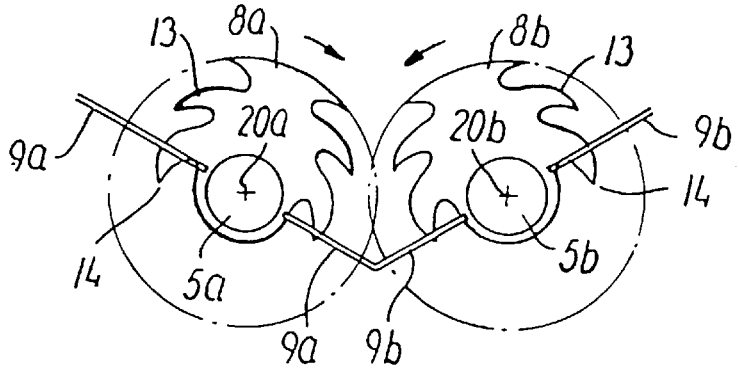

FIG. 9 such shows in fragments the same construction as already has been shown in details in FIGS. 1–4. At each side of the axle 5*a* there is placed at set of lower knives 9*a* flushing with each other. Also there is at each side of the axle 5*b* placed a second set of lower knives 9*b* flushing with each other. The set of knives 9*a* and 9*b* are extending into direction of the axles 20*a,b* of the axles 5*a,b* in question, and form furthermore two and two a V with each other. Thereby the same expedient effects are obtained as said before in connection with the description of the embodiments shown in FIGS. 6–8 having only one axle. By using two axles it is, however, possible to increase the capacity of the machine as compared to a similar machine with only one axle. The co-operation of the two machines with the cutting table will in itself lead to a doubling of the capacity, but to this can be added, that the two axles also co-operate mutually in the comminution process, when they rotate at such directions of rotation that those teeth from the upper knives which at a given moment are at the top, will be moving towards each other. The resulting capacity can therefore be more than twice as large when two axles are use in stead of only one.

Figure 10:
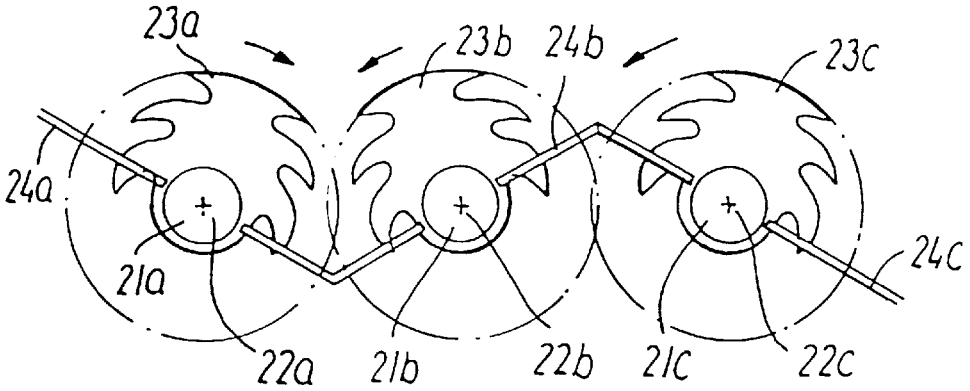

An even larger capacity can be obtained, when there, as shown in fragments in FIG. 10, are used three axles 21*a,b,c* with upper knives 23*a,b,c*. Flushing sets of lower knives 24*a*, 24*b* and 24*c* are placed at each side of the axles 21*a*, 21*b* and 21*c*. The sets of knives 24*a* and 24*b* form two and two a V with each other, while the sets of knife 24*b* and 24*c* two and two form a reversed V with each other. This machine has a large capacity and combines the advantages, which have been described in connection with the description of FIGS. 9 and 10. The material is guided into between the upper knives 23*a* and 23*b* by the V, which is formed by the sets of lower knives 24*a* and 24*b*. The reversed V, which is formed by the sets of lower knives 24*b* and 24*c*, gives the teeth of the upper knives 23*b* and 23*c* a larger a free scope to process the material in this part of the funnel. As a consequence of the directions of rotation of the upper knives 23*c* these upper knives will advantageously be inclined to push some of the material into that part of the funnel, where the upper knives 23*b* are operating, whereafter this material is processed by the upper knives 23*a,b*.

Figure 11:
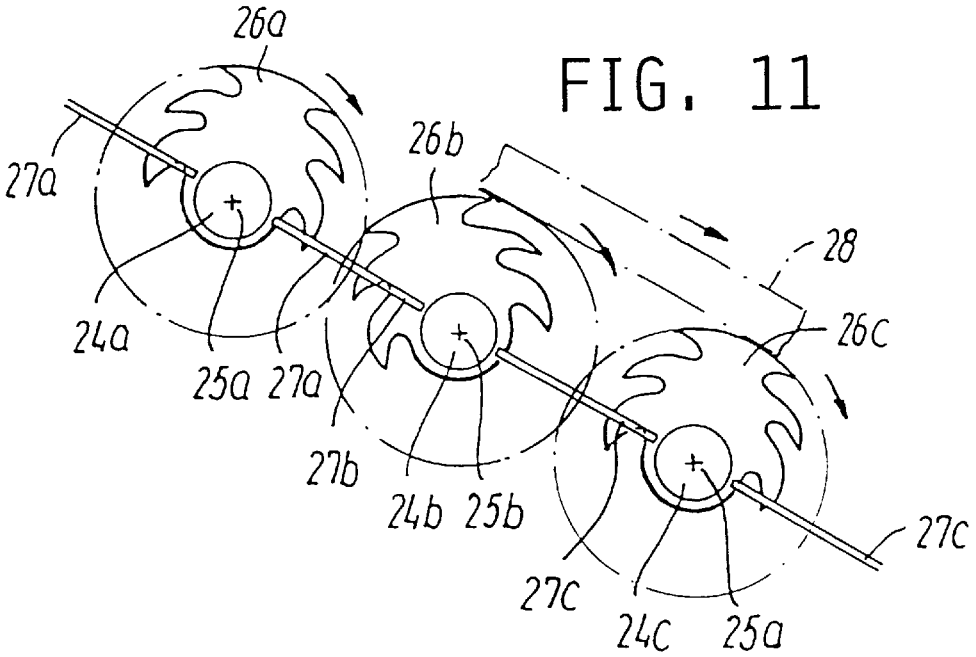

Also the machine shown in fragments in FIG. 11 is provided with three axles 24*a,b,c* with axis 25*a,b,c*, which however, in this case all are lying in a diagonally slanting plane. Furthermore the lower knives 27*a,b,c* are flushing with each other into a direction, which is parallel to the plane through the axis of the axles.

Sometimes objects are found among the material, which is to be comminuted, which are so strong that the machine cannot cut or tear these objects apart. In the figure is shown such an object, which e.g. can be a cylinder block, which now is wanted to be removed from the machine. This takes place by manually or automatically rectifying the direction of rotation of the upper knives 26*a,b,c*, so that the teeth of the upper knives being at the top at a given moment, as shown by the arrows, all are being brought to move into the direction of inclination. The upper knives will then work as a kind of a rolling table, where the rolls are the driven upper knives, which now themselves drive the cylinder block out of the machine. To pick out for instance a cylinder block from the other materials in the machine, while this is in operating, would normally be a difficult and utmost risky operation for the operating staff. Therefore, the machine would have to be stopped completely, while the cylinder block is removed, resulting in a loss of profits equal to the time of the standstill. With the embodiment shown in FIG. 11 the comminution machine obtains, however, to be automatically self-emptying.

The invention is described above and shown on the drawing from the presumption that the material was comminuted between the teeth of the upper knives and the upper side of the lower knives, or said in another way, that the lower knives are only to have cutting edges at the top. Opposite to a conventional comminution machine, the machine according to the invention can, however, within the scope of the invention, operate with cutting edges at the top as well as at the bottom. This is illustrated with the very schematically shown FIGS. 12–13.

Figure 12:
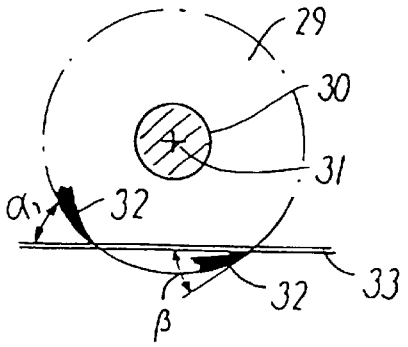
FIG. 12 (PRIOR ART)

In FIG. 12 thus is seen, in fragments, a conventional machine with an axle 30, which has an axis 31, and to which the upper knives 29 with teeth 32 are fixed. The lower knives 33 are placed somewhat below the axle 30, and as it can be seen, this results in the fact that the teeth 32 attack the material from the top in a disadvantageous acute angle and in the same movement then meet the lower knife from the bottom at such an acute angle that a cutting- and tearing apart operation can only be made with difficulty or not at all.

Figure 13:
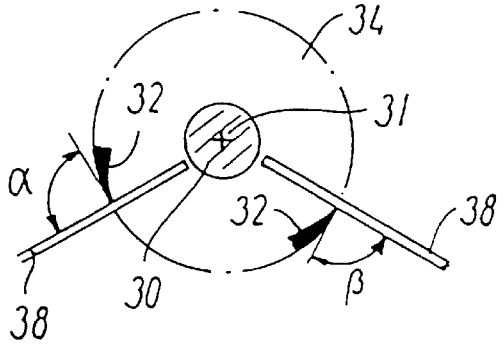
Figure 14:
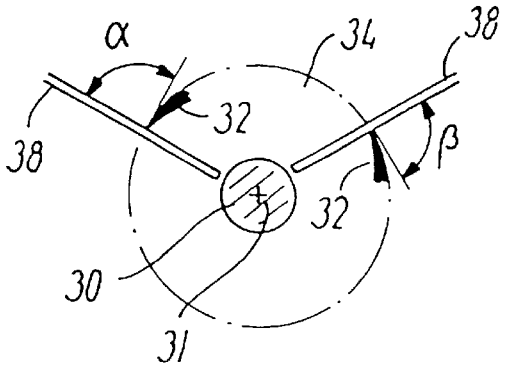

FIGS. 13 and 14 show in fragments a machine according to the invention with a set of lower knives, which form a reversed V and a V, respectively. The upper knives 34 are fixed to the axle 35 having the axis 36. The lower knives 38 have a direction towards this axis, and as it can be seen, the teeth of the upper knives will therefore when rotating, pass the lower knives at angles and , which both are 90°. By providing the lower knives with cutting edges at both sides, the material, which has come below the knives, now advantageously have the possibility of being cut or torn apart between the cutting edge of the bottom side of the lower knife and the teeth of the upper knives when these are passing up between the lower knives.

The invention is furthermore described and shown on the drawing from the presumption that the lower knives were straight. Within the scope of the invention the knives, can, however, have any shape.

Figure 15:
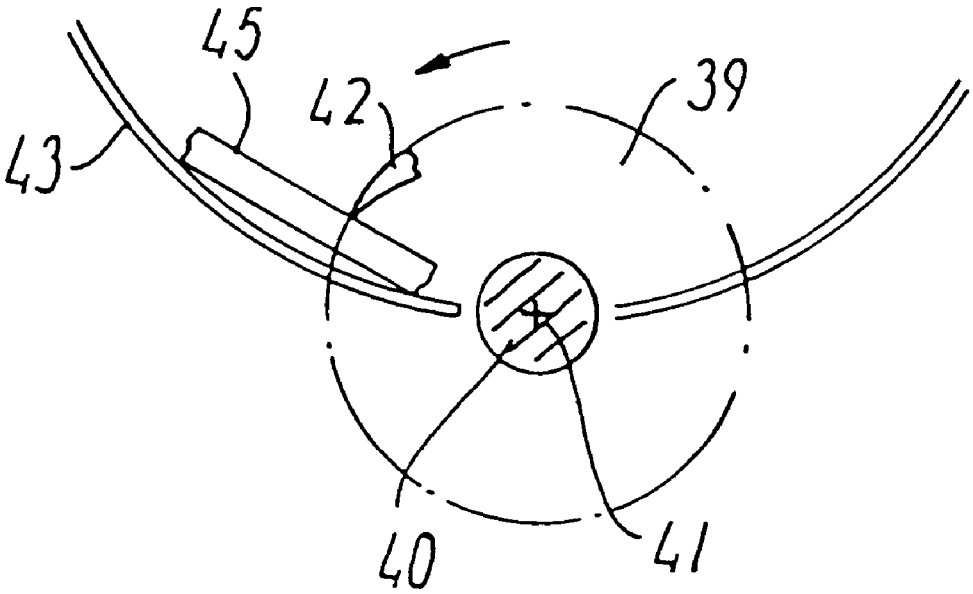
Figure 16:
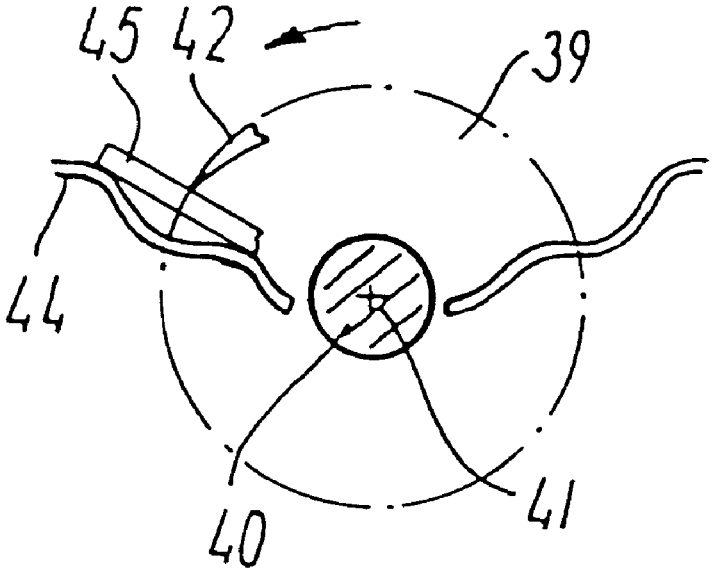

FIG. 15 thus shows, very schematically, an embodiment with arched lower knives 43. Of the upper knife 39, which is fixed to the axle 40 having the axis 41, is only shown a single tooth 42, which attacks an object 45, which is to be comminuted. The arched form of the lower knife has the effect that the object 45 in the shown situation only repose on the lower knife with the ends, which lower knife therefore will have an influence on the object with much larger partial shear stresses, than if the object was supported in its total length. The cutting takes therefore place successively towards the centre from the ends of the object, and therefore requires a smaller input moment of the machine than if the knife was straight. A similar advantage can be obtained with the embodiment schematically shown in FIG. 16, where the lower knife 44 has a wavy cutting edge.

I claim:

1. A machine for comminution of materials, said machine comprising:

a funnel for accommodating waste, at least one rotatable axle of a drive unit, said axle having an axis, a cutting table placed at a bottom of the funnel below said at least one rotatable axle and having at least one set of fixed, parallel lower knives at each side of said at least one rotatable axle, said lower knives being separated by openings through the table and extending in a direction perpendicular to the at least one rotatable axle, and a number of disc-shaped upper knives fixed to the at least one rotatable axle, each of the upper knives including a number of teeth partly extending down into each of the openings of the table, whereby each opening is wider than an associated upper knife which furthermore is placed close to one of the lower knives in the associated opening, the lower knives extending in a direction intersecting an area located adjacent to the axis of the at least one rotatable axle, and tips of the teeth of the upper knives extending in a circumferential direction around the axis of the at least one rotatable axle.

2. A machine according to claim 1, wherein each lower knife forms an angle of between 0° and 30° with a plane containing the axis of the rotatable axle and an outer end of the lower knife situated opposite to the rotatable axle.

3. A machine according to claim 1, wherein the lower knives in the two sets of the lower knives situated at each side of the rotatable axle, two by two, form a V.

4. A machine according to claim 1, wherein the lower knives in the two sets of the lower knives situated at each side of the rotatable axle, two by two, form a reversed V.

5. A machine according to claim 1, wherein the lower knives in the two sets of the lower knives situated on each side of the rotatable axle, two by two, are flush with each other.

6. A machine according to claim 1, wherein the knives in the two sets of the lower knives situated on each side of the axle, two by two, are flush with each other extending in a direction which forms an angle to a horizontal plane.

7. A machine according to claim 1, wherein there are at least two knife axles and the lower knives in the two sets of the lower knives situated at each side of one of the two knife axles, two by two, are flush with each other extending in a direction forming an angle to at least the lower knives in one of the two sets of the lower knives situated on each side of the adjoining axle.

8. A machine according to claim 1, wherein there are at least two knife axles, and all of the lower knives associated with the cutting table are flush with each other and extending in a same direction, and said direction forms an angle with a horizontal plane.

9. A machine according to claim 1, wherein each lower knife has an upper and a lower cutting edge, respectively.

10. A machine according to claim 1, wherein at least some of the knives are placed at different levels.

11. A machine according to claim 1, wherein the lower knives are straight.

12. A machine according to claim 1, wherein at least one of the lower knives of a knife set extends diagonally towards an associated knife axle.

13. A machine according to claim 1, wherein the lower knives are provided with a wavy cutting edge on at least one side.

14. A machine according to claim 1, wherein inner ends at an axle of the lower knives in two of the lower knives, placed at each side of an axle in a set of the lower knives, are connected by a bridge below the axle.

* * * * *